United States Patent [19]

Thompson

[11] 4,067,462

[45] Jan. 10, 1978

[54] COKE OVEN PUSHING AND CHARGING MACHINE AND METHOD

[76] Inventor: Buster Ray Thompson, Rte. 1- Lowes Ferry Pike, Louisville, Tenn. 37777

[21] Appl. No.: 581,406

[22] Filed: May 27, 1975

Related U.S. Application Data

[62] Division of Ser. No. 431,804, Jan. 8, 1974, Pat. No. 3,912,091, which is a division of Ser. No. 240,937, April 2, 1972, Pat. No. 3,784,034.

[51] Int. Cl.[2] ..... C10B 33/10

[52] U.S. Cl. ..... 214/23; 432/235

[58] Field of Search ..... 214/23; 202/262; 432/233, 235

[56] References Cited

U.S. PATENT DOCUMENTS

| | | | |
|---|---|---|---|
| 1,422,442 | 7/1922 | Haugh et al. | 214/23 |
| 2,609,948 | 9/1952 | Lavely | 214/23 |

*Primary Examiner*—Robert G. Sheridan

*Attorney, Agent, or Firm*—Beveridge, DeGrandi, Kline & Lunsford

[57] ABSTRACT

A combined coke oven pushing and charging machine is supported on tracks for movement along the front of a bank of coke ovens and is operable to open an oven door, push the coke from the open oven, and close the oven door, and to open the door of an adjacent empty oven, charge the oven with a uniform, level, compact charge of coal, and close the door. The machine is then moved along the track a distance equal to the width of one oven, a second oven is pushed, and the oven previously pushed is charged. The pusher head is provided with roller supports adapted to roll along the oven floor during the pushing operation, and the head is water cooled to prevent warping and damage by the intense heat of the coke. The coal is deposited into the empty ovens by a drag-type endless chain conveyor having a width substantially equal to the width of the coking chambers and which is telescoped into the oven from the pusher door opening. The generally horizontal cantilevered conveyor simultaneously fills, levels, and compacts the coal in the coking chamber.

3 Claims, 14 Drawing Figures

COKE OVEN PUSHING AND CHARGING MACHINE AND METHOD

This is a division of application Ser. No. 431,804, filed Jan. 8, 1974, now U.S. Pat. No. 3,912,091, which is a division of prior application Ser. No. 240,937, filed Apr. 2, 1972, now U.S. Pat. No. 3,784,034.

BACKGROUND OF THE INVENTION

1. Field of the Invention

This invention relates to a method of and an apparatus for use in the production of coke, and more particularly to an improved method of an apparatus for handling coke oven doors, pushing coke from ovens, and charging the ovens with a uniform, level, compact charge of coal.

2. Description of the Prior Art

In the operation of banks of modern, nonregenerative coking ovens, the conventional practice is to charge the individual ovens, through charging holes in their tops, from cars which run along rails on the top of the bank of ovens. These cars carry hoppers which are normally filled with enough coal to completely charge an oven. Since the charging holes are spaced along the length of the ovens, the top surface of the charge of coal, as deposited, is uneven and must be leveled within the hot ovens to prevent uneven coking.

The coal charges are leveled in the coking chamber by an elonaged, substantially horizontal, cantilevered leveling bar which is telescoped into the coking chamber through a leveling bar opening in the oven door and moved back and forth over the top of the charge until the charge is more or less level. The bar is then withdrawn, the leveling bar opening is closed, and the coking process continues.

In view of the size of modern coking ovens, which may be in excess of 50 feet in length and up to 11 feet in width, it is readily seen that the cars employed to charge such ovens would necessarily be extremely heavy. The live weight of the cars, when loaded with a charge of 25 to 40 tons of coal or more, would put substantial stress on the bank of ovens.

The use of a leveling bar to level a charge of coke in an oven, particularly the modern, large, nonregenerative ovens, has not been entirely satisfactory for several reasons. In the first place, the leveling operation is time consuming and permits substantial heat loss from the oven as a result of the oven being open during the leveling operation. Further, the very large, wide ovens in use today are very difficult to level by passing a cantilivered bar projecting from its mobile support in front of the bank of ovens, back and forth over the surface of the charge in the oven. The tendency of such long leveling bars to droop toward the back of the oven tends to produce an uneven charge, and to compact the coal to a greater extent toward the back of the oven. Also, withdrawing the pusher bar from the hot oven invariably drags a quantity of coal out of the oven through the pusher opening. This coal may be ignited from the intense heat of the oven, a fact which further complicates the task of cleaning up or removing the coal.

Once the coking process is completed, a pushing machine which moves along tracks in front of the bank of ovens (and which normally supports the leveling bar) is positioned in front of the particular oven, and the front (pusher) and rear (coke) doors of the oven are removed. A large ram having a pusher head substantially the width of the coking chamber is forced through the pusher door opening and into contact with the cake of hot coke in the oven. Sufficient force is applied to the ram to force the cake of coke through the coking chamber and out the coke door into a hot car or other suitable receptacle positioned adjacent the coke door. Immediately upon receiving the charge of incandescent coke, the hot car is transferred to a quenching shed where the coke is quenched with water.

The intense heat of the coke, and of the oven walls, is extremely damaging to the pusher head. Even though these heads are normally constructed of heavy, heat-resistant alloy steels, the extreme temperatures and heavy loads to which they are subjected results in their quickly becoming warped and distorted, frequently to the extent that they do not do a good job of pushing the coke from the oven. In normal use, a pusher head of conventional construction may have a life expectancy of 6 weeks or less.

Numerous attempts have been made in the past to overcome the difficulties in charging and pushing coke ovens by the conventional process. For example, numerous devices have been proposed for side-loading the ovens, i.e., loading the ovens through the pusher door, or through the leveler bar opening in the pusher door. For example, U.S. Pat. No. 2,754,981 discloses a centrifugal blower structure for blowing coal into an oven through the normal leveler bar opening in the pusher door. While such a device may be useful in charging the coking chamber of a narrow regenerative retort (which may have a total width on the order of 18 inches), it can not be employed to deposit a uniform, level charge of coal in a large, nonrecovery oven which may have a width of from 6 to 11 feet, or more, and a length of from 30 to more than 50 feet. Further, even if the discharge end of a centrifugal blower conduit could be controlled accurately enough to deposit a level charge in such a large oven, the time required to charge the oven would be prohibitively long, and the intense heat of the oven, which may be as high as 2,000 to 2,600° F during the charging operation, would soon destroy the conveyor structure. Also, such a device would be totally ineffective in compacting the top surface of the charge of coal.

Other side-loading devices, including screw-type conveyers, centrifugal throwers, and endless chain conveyers, have also been proposed to avoid the defects of the conventional top-loading process; however, these devices generally have been unsuccessful, with the result that the prevelant current practice is still to charge the ovens through the top as described above.

SUMMARY OF THE INVENTION

The foregoing and other defects of the prior art methods and apparatus for pushing and charging coking ovens are overcome in accordance with the present invention by an integrated apparatus for pushing, charging, leveling and compacting large non-regenerative coking ovens. This is accomplished in an extremely quick and efficient manner, leaving the ovens open for a minimum of time to thereby conserve heat in the ovens during the pushing and charging operations and to minimize the smoke and other pollutants discharged into the atmosphere during these operations. The apparatus is designed to move on tracks in front of and parallel to the bank of ovens in a manner similar to the conventional pushing and leveling machines, and is adapted to either alternately push one oven and charge the adjacent oven without moving the machine, or to push and subsequently charge a single oven.

The pushing and charging machine of this invention includes a large, self-propelled car structure having a width sufficient to span the fronts of two adjacent ovens in a bank. A pair of door handling mechanisms are positioned to engage and remove the pusher doors from each of two adjacent ovens without requiring the apparatus to be moved along its supporting track. The first door handling mechanism is adapted to remove and support the door of an oven in an elevated position to permit the pusher ram to move therebeneath and into the pusher end of the oven. The pusher head is equipped with roller support means which engages and rolls along the floor of the oven to maintain the lower edge of the pusher head in slightly spaced relation above the floor to thereby avoid damage to the oven floor while assuring that all of the coke is pushed therefrom. To prevent damage to the pusher head from the extreme heat of the incandescent coke in the oven as it is being pushed, cooling water is circulated through a system of channels in the pusher head. Water is supplied to these channels through conduits extending along the hollow pusher arms employed to support and push the head through the oven. As soon as the coke is pushed from the oven, the pusher ram is withdrawn and the oven doors are closed to preserve the heat in the oven.

The second door lifting mechanism is adapted to remove and support the door of the adjacent oven in an elevated position to permit the charging of the oven through the open door. Immediately upon opening the door, a false door, having a height equal to the height of the charge of coal to be deposited in the oven, is positioned in the door opening to act as a barrier to prevent the charge of coal from flowing out of the open door. The false door is mounted on the forward edge of a movable, horizontal platform or bridge which extends from the false door to a position beneath a coal hopper mounted upon the movable car structure. The movable platform is substantially the same width as the width of the coke chamber of the oven to be filled.

An endless drag-type conveyer is supported on the apparatus for movement into and out of the open end of the oven to be charged. The conveyor includes a pair of parallel, laterally spaced chains each supported for movement about an endless path on a separate side beam which, in turn, is supported as a movable cantilever beam for projection above the lateral edges of the movable platform and into the coking chamber of the oven along the sidewalls thereof. A plurality of parallel bars have their opposed ends fixed to the conveyer chains for movement therewith to drag a charge of coal from the hopper over the movable platform and into the oven. By driving the conveyer chains to convey coal into the oven as the conveyer is being telescoped into the open oven, the oven is filled from the pusher end thereof so that the charge of coal, engaging the parallel drag bars, supports a substantial portion of the weight of the cantilevered conveyer structure. At the same time, the weight of the conveyer structure, acting through the parallel bars, compacts the charge of coal throughout the length of the oven. Further, since the conveyer structure is substantially the same width as the coking chamber, the parallel, horizontally extending bars moving over the top of the charge completely levels the charge of coal in the oven throughout the full length and width of the charge.

DESCRIPTION OF THE DRAWINGS

Other objects and advantages of the method and apparatus according to the present invention will become apparent from the detailed description hereinbelow, taking in conjunction with the drawings in which.

DESCRIPTION OF THE PREFERRED EMBODIMENTS

Figures 1, 2:
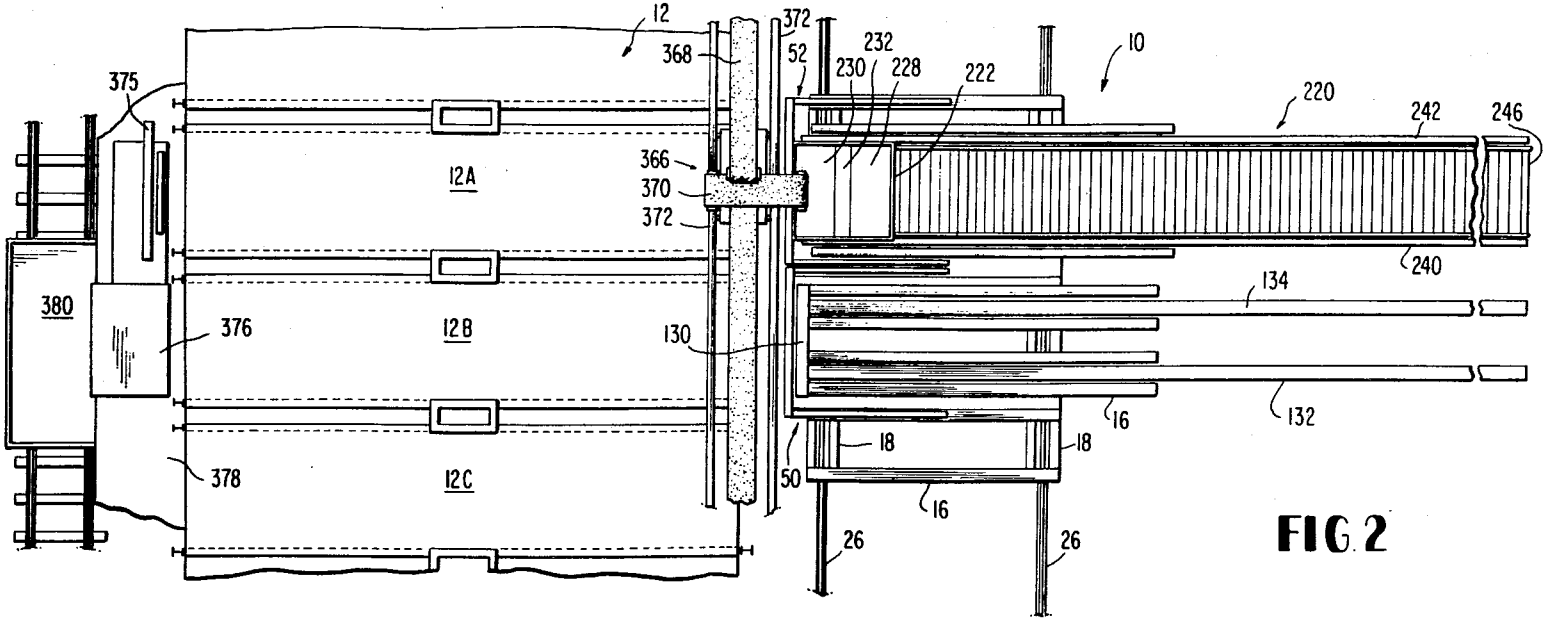
FIG. 1 is an elevation view, partially in section, of a front loading, nonregenerative coke oven with the pushing and charging apparatus of the present invention positioned in front thereof.
FIG. 2 is a top plan view of the structure shown in FIG. 1.
Figure 3:
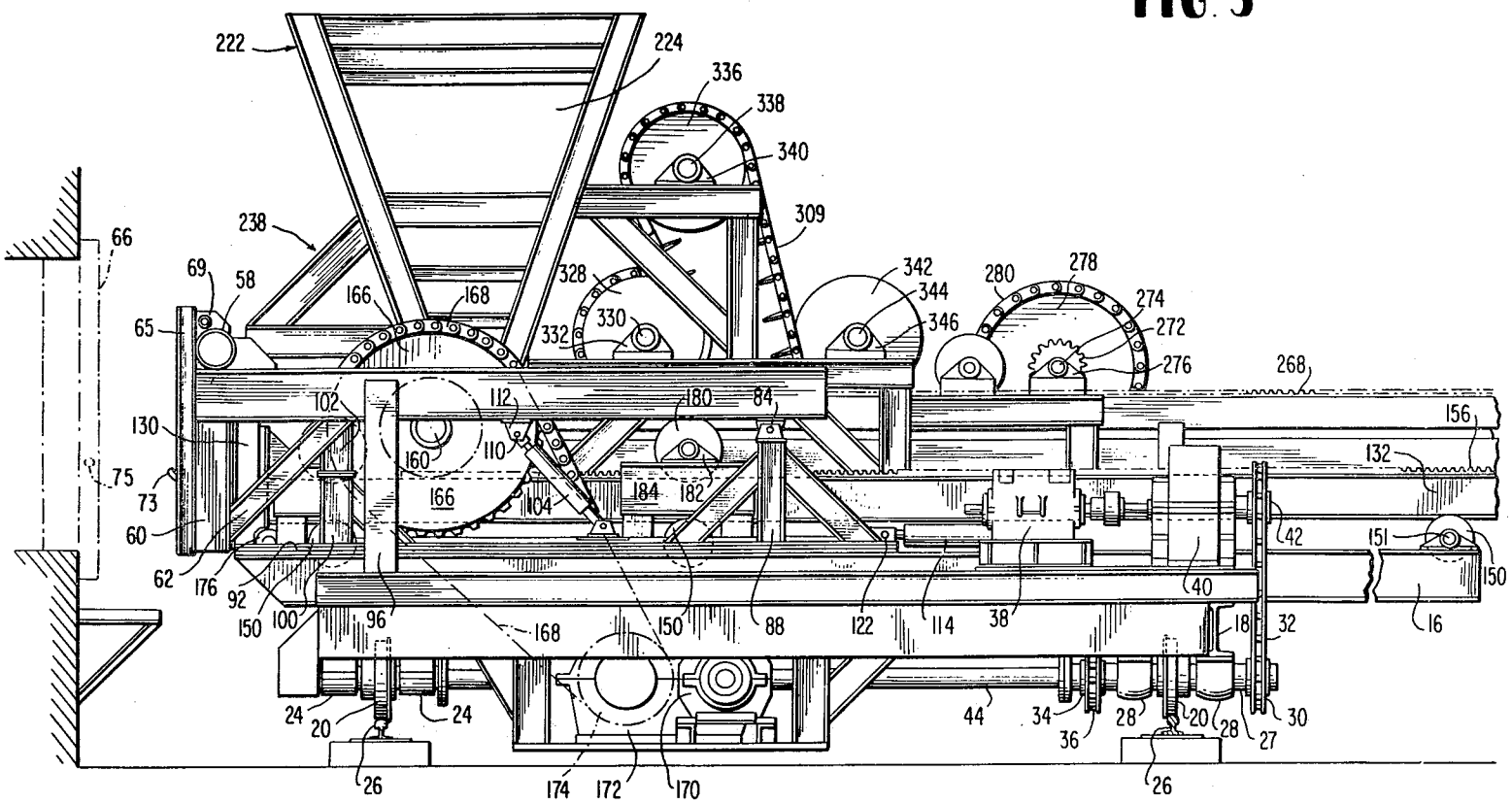
FIG. 3 is an enlarged view, in elevation, of a portion of the apparatus shown in FIG. 1.
Figure 4:
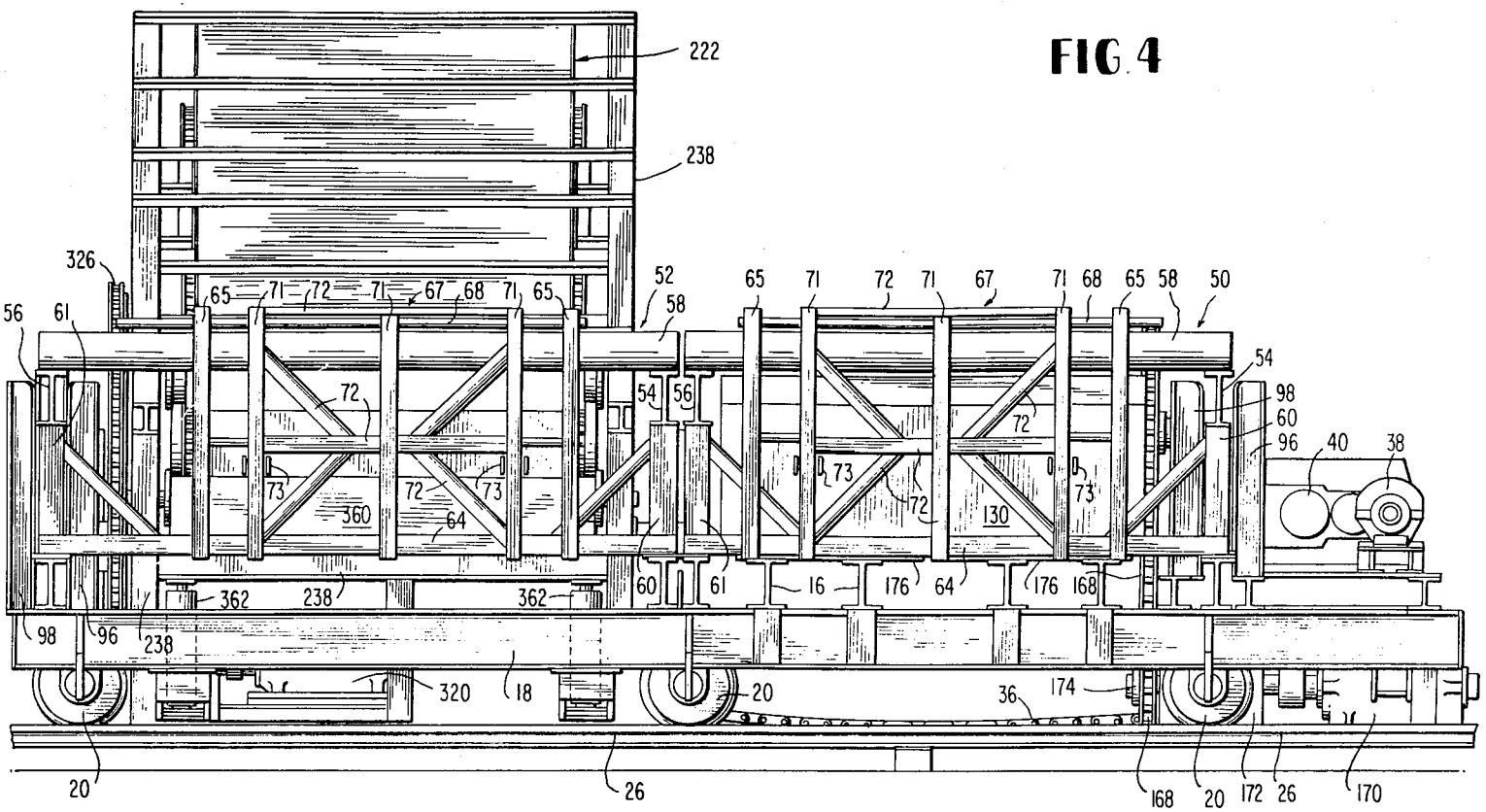
FIG. 4 is a front elevation view of the structure shown in FIG. 3.
Figure 5:
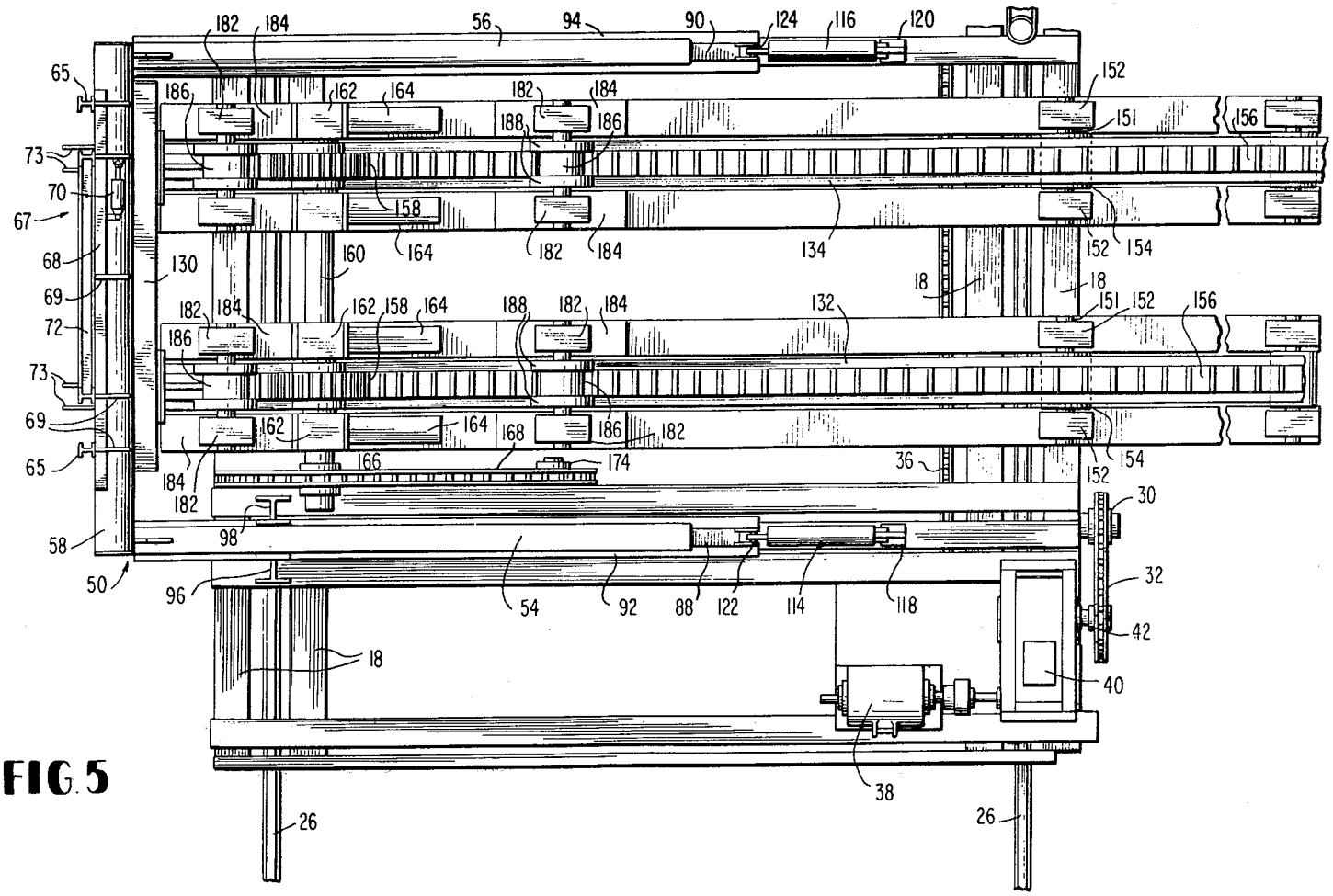
FIG. 5 is a further enlarged, top plan view of the left door lifting and the coke pushing portion of the apparatus.
Figure 6:
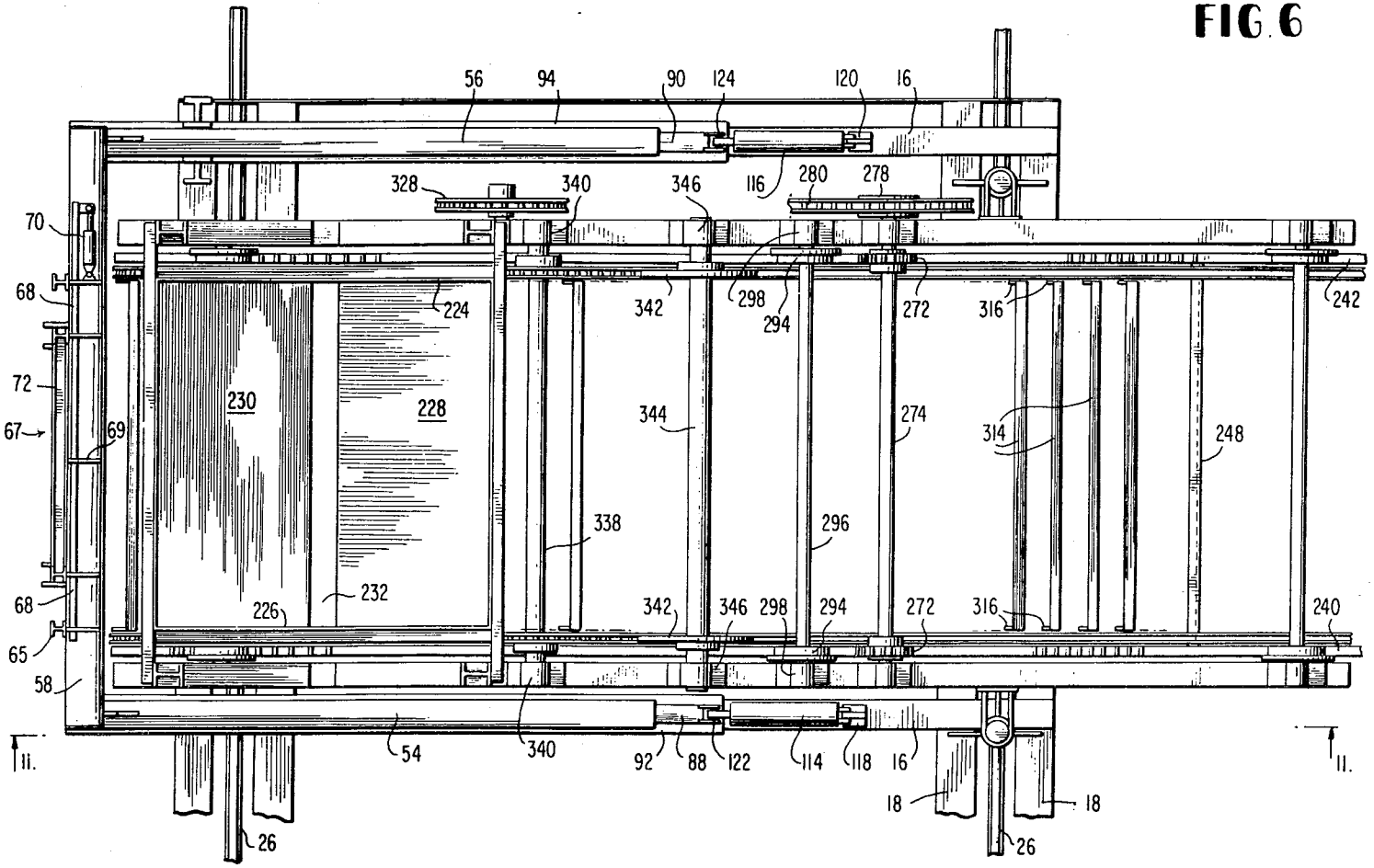
FIG. 6 is a view similar to FIG. 5 and showing the right door lifting and the coal conveying portions of the apparatus.

Referring now to the drawings in detail, the pushing and charging apparatus according to the present invention is indicated generally in FIGS. 1 and 2 by the referenced numeral 10 and is illustrated in position in front of a bank of nonregenerating coking ovens 12. The machine 10 includes a generally rectangular frame assembly 14 including a plurality of transversely extending beams 16 having their opposed ends rigidly welded to a pair of longitudinally extending girder assemblies 18. As best seen in FIG. 4, the front girder assembly 18, i.e., the one closest to the front of the ovens, is supported on the cooperating track 26 by three flanged wheels 20 mounted, as by axles, or shafts 22, supported by pillow blocks 24. The wheels 20 are mounted one adjacent each end of the girder assembly and one near the middle thereof. The rear girder assembly 18 is supported by similar flanged wheels 20 each mounted on a pinion shaft 27 supported on the bottom surface of the rear girder assembly 18 by a pair of journal bearings 28. A sprocket 30 mounted on the end of one of the pinions 27 is driven by a suitable drive chain 32 to propel the assembly along the track 26. To assure adequate traction to move the heavy apparatus, a second sprocket 34 is mounted on the inner end of the driven pinion shaft 27, and a second chain 36 extending therearound engages and drives a similar sprocket on the rear center drive wheel pinion, not shown. Power to propel the apparatus along the track is supplied by an electric motor 38, acting through a suitable reduction gear mechanism 40 to drive a sprocket 42 which, in turn, drives the chain 32. As indicated in FIG. 3, the drive pinions 27 are coupled to the axles 24 through an elongated, flanged axle member 44. Preferably, the reduction gear 40 is a variable speed, reversible mechanism incorporating suitable clutching devices to facilitate accurate positioning of the machine in front of the ovens 12.

Referring to FIGS. 1 through 7 of the drawings, it is seen that the machine 10 includes two door handling and lifting assemblies indicated generally by the reference numerals 50, 52, respectively. Door handling assembly 50 is located on the left side of the apparatus, as viewed from the operator's control cabin 54 at the rear of machine 10, while door handling assembly 52 is located on the right side of the apparatus. Door handling assemblies 50, 52 are positioned and adapted to engage and handle the pusher door on adjacent coking ovens so that the two adjacent ovens may be opened and closed without requiring the apparatus to be moved along its supporting tracks in front of the bank of ovens. Since assemblies 50, 52 are substantially identical in construction and operation, only the assembly 50 will be described in detail, with like reference numerals being applied to designate corresponding elements of the door handling assembly 52.

The door handling assembly 50 includes a pair of laterally spaced, parallel beam members 54, 56 rigidly connected at their forward end by a tubular structural member 58. A pair of vertically extending post members 60, 61 are mounted on the forward end of beams 54, 56 and are reinforced by brace members 62. Post members 60, 61 support a second cross beam 64 which cooperates with cross beam 58 to define a generally rectangular structural frame normally having its front surface disposed in a vertical plane. A pair of laterally spaced, vertically extending structural members 65 are rigidly welded on the forward face of the lifter frame in position for their forward face to engage cooperating bearing surfaces on the metal framework adjacent the side edges of an oven door 66.

A rigid, generally rectangular door clamping and support assembly 67 is mounted on the front face of the lifter frame between structural members 65 and is supported for limited lateral sliding movement therebetween by an elongated bar member 68 which, in turn, is slideably supported by a plurality of guide brackets 69 rigidly welded to the top member 58. A double-acting linear fluid motor 70 has one end connected to the bar 68 and its other end connected to the top member 58, or through one of the brackets 69, to move the support assembly 67.

As seen in FIG. 4, the door clamping and support assembly 67 includes three laterally spaced, vertically extending beam members 71 rigidly connected by suitable brace members 72. The spacing of the beam members 71 corresponds to the spacing of structural steel reinforcing members (not shown) on the outer surface of the oven door, and the fluid motor 70 permits minor adjustments of the position of the beams 71 to assure accurate alignment with the door reinforcing members.

Figure 12:
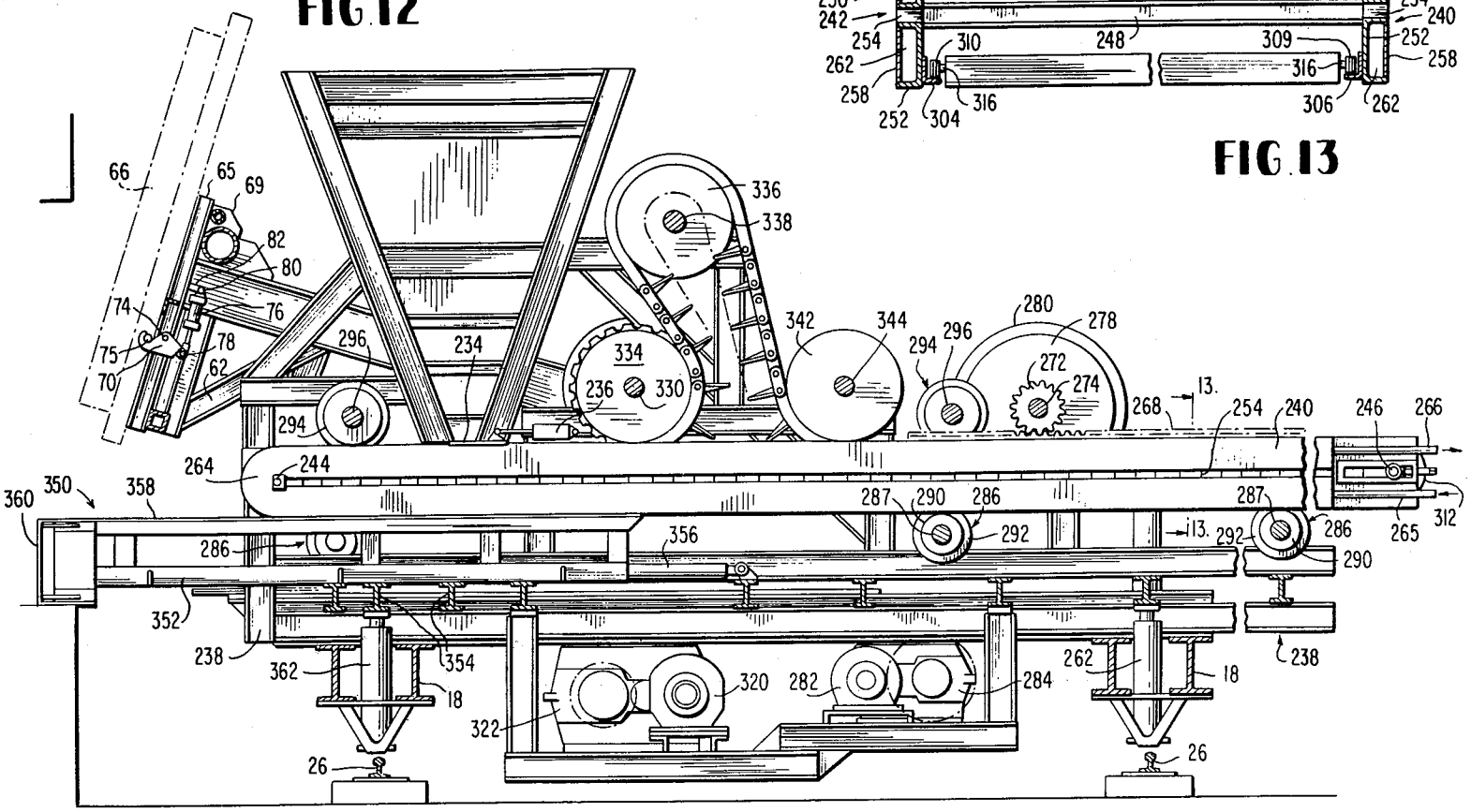
FIG. 12 is a view similar to FIG. 11, with certain of the elements shown in an alternate position.

A pair of U-shaped hook members 73 (see FIG. 12) have their legs pivotally mounted, as by pins 74 on the two outboard structural beams 71, with the free hook-shaped ends of the two legs projecting outwardly therefrom to engage a cooperating lifting bar 75 on the oven door 66. Hook members 73 are pivoted about pin 74 to clamp and release the bar 75 by a linear fluid motor 76 having its piston pivotally connected, as by pin 78, to the hook member, and its cylinder end connected as by pin 80 and bracket 82, to the lifter frame. Thus, actuation of the fluid motor 76 to rotate the hook members 73 in a counterclockwise direction, as seen in FIG. 12, will retract the hook portion of the member to a position rearward of the forward face of the lifter frame to permit the forward face of the frame to be positioned in contact with the pusher door when the door is in its closed position on an oven. Actuation of the fluid motor in the opposite direction will then rotate the clamp members 73 clockwise to project the forward hook portion of the members to partially encircle the lifting bars 75 and rigidly clamp the door into engagement with the forward face of the lifter frame, and will support the door in this position for removal and lifting by the door handling assembly.

The rearward ends of the door lifter beams 54, 56 are pivotally supported, as by pins 84, 86 respectively, on rigid brackets 88, 90. The brackets 88, 90 are rigidly welded to and project upwardly from base plates 92, 94, respectively, which, in turn, are slideably supported on the top flange of a spaced pair of the transverse beams 16 of the frame assembly 14. A pair of guide posts 96, 98 are rigidly welded to the frame 14 and project upwardly along each side of the base plate 92 and the beam 54 to maintain the assembly in alignment along the top of the supporting frame beam members. The base plates 92, 94 each have a support post 100 rigidly welded on and projecting upwardly from their forward ends in position to engage a downwardly extending post member 102 on the beams 54, 56 to support the pivoted lifter assembly when the lifter frame is in its lowered position.

Figures 7, 8, 9, 10:
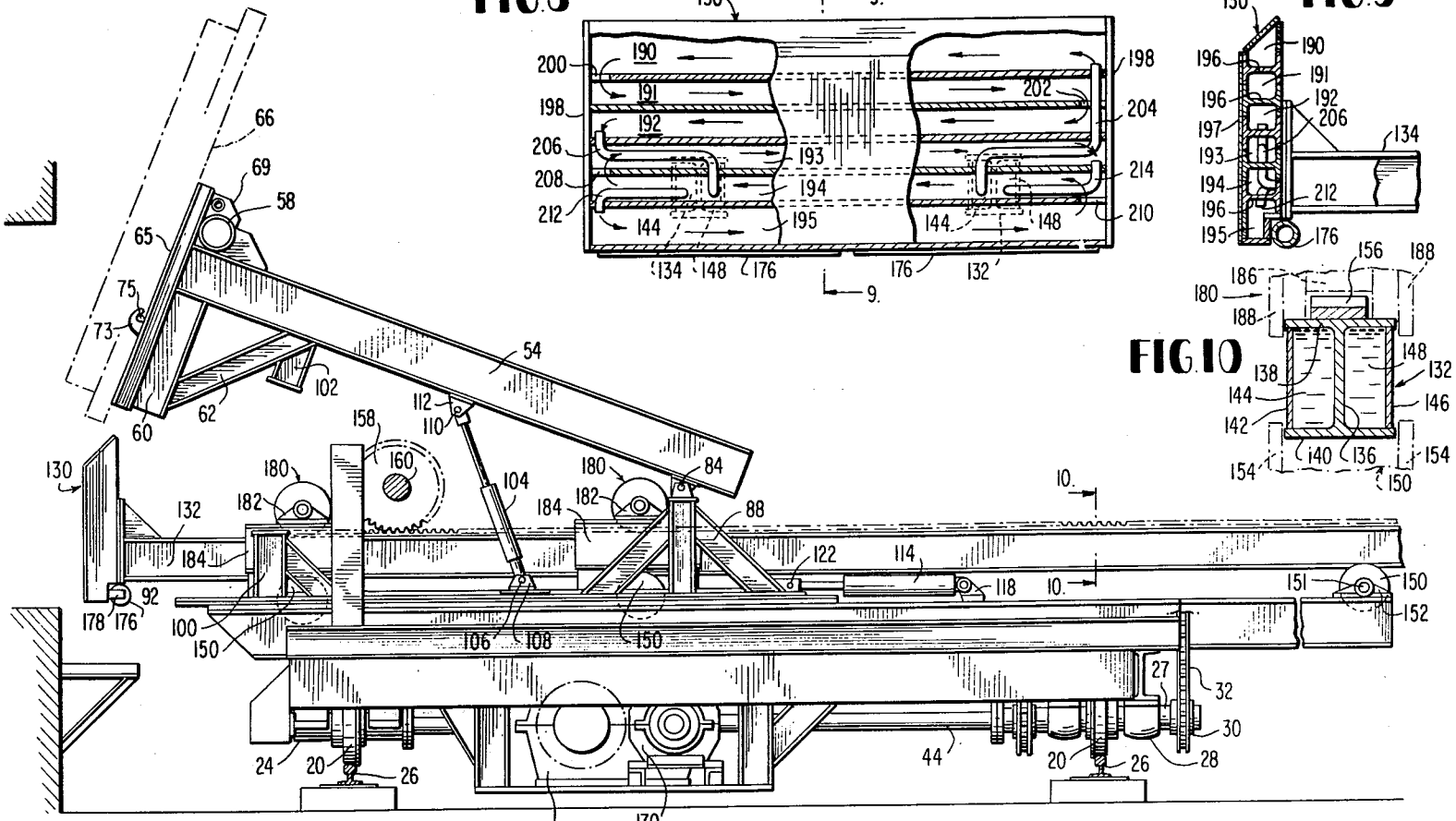
FIG. 7 is an elevation view of the structure shown in FIG. 5, with certain elements shown in an alternate position.
FIG. 8 is an enlarged elevation view of the pusher head, with portions broken away to more clearly show other portions thereof.
FIG. 9 is a fragmentary sectional view taken on line 9—9 of FIG. 8.
FIG. 10 is a sectional view taken on line 10—10 of FIG. 7.

The lifter frame is moved between a lowered position shown in FIGS. 3 and 4 and a raised position shown in FIG. 7 by a linear fluid motor 104 having its piston end connected by pin 106 and bracket 108 to the beam 54 and its cylinder end connected by pin 110 and bracket 112 to the base plate 92. A similar fluid motor, not shown, extends between base plate 94 and beam 56 and cooperates with the motor 104 to raise and lower the lifter frame.

A second pair of fluid motors 114, 116 are employed to slide the base plates 92, 94 along their supporting frame members 16 toward and away from the bank of ovens. Motors 114, 116 have their cylinder ends pivotally connected to the frame cross members 16 by brackets 118, 120, respectively, and their piston ends connected to the brackets 88, 90, respectively, by pins 122, 124.

The door handling assembly is employed to remove an oven door by initially positioning the machine 10 in front of the bank of ovens with the lifting hooks 73 in alignment with and outwardly spaced from the lifting bars 75 on the oven door. Fluid motors 114, 116 are then actuated to slide the assembly along the top flanges of the supporting beams 16 to engage the front surface of the lifting frame members 65, 71 with the oven door, and the fluid motor 76 is actuated to pivot the clamping hooks 73 in a clockwise direction to firmly engage the lifting bars 75 and clamp the oven door onto the lifting frame. The oven door lock is then released, and motors 114, 116 are actuated to withdraw the door 66 in a horizontal direction a distance sufficient to clear the oven door opening. Fluid motors 104 are then actuated to pivot the lifting frame, with the door clamped thereon, upwardly about the pivot pins 84 to support the door clear of the door opening to permit coke to be pushed from the oven, in the case of the door handling assembly 50, or in the case of assembly 52, to permit a charge of coal to be placed in the oven through the pusher door opening.

Referring now to FIGS. 1–5 and 7–10, it is seen that the coke pushing assembly is supported for reciprocable movement toward and away from the bank of ovens through the left door handling assembly 50, when the lifting frame is in the elevated position. The pusher mechanism includes a pusher head 130 rigidly mounted on the forward ends of a pair of horizontal, laterally spaced pusher arms 132, 134. The arms 132, 134 are identical in construction and accordingly only the left arm 132 will be described in detail, with identical reference numerals being employed to indicate corresponding parts of the right arm 134. As best seen in FIG. 10, arm 132 is a composite structure made up of a heavy, wide-flange beam having a central web 136 and top and bottom flanges of 138, 140, respectively. A first vertical side plate 142 is welded to the lateral edges of flanges 138, 140 at one side of the beam and cooperates with the flanges and web 136 to define a first fluid tight chamber 144 extending the length of the arm. A second side plate 146 is rigidly welded to the edges of flanges 138, 140 on the opposite side of the beam to define a second fluid tight channel 148. Thus, the flanges 138, 140 and the plates 142, 146 cooperate to define a generally rectangular closed beam structure having two parallel channels 144, 148 extending therethrough.

The arms 132, 134 are supported for reciprocable movement transversely of the machine 10 and toward and away from the bank of ovens 12 by a plurality of support rollers 150 mounted on shafts 151 which, in turn, are journaled for rotation about their respective axes by a pair of bearings 152 mounted on transverse beams 16 of the machine frame 14. The rollers 150 each have radially extending flanges 154 (FIG. 10) on their opposed ends which project upwardly along the edges of flange 140 to act as a lateral guide for the arms 132, 134 during their movement into and out of the ovens 12.

An elongated rack 156 is mounted on the top of arms 132, 134, with gear teeth formed on the top face of the racks being adapted to mate with corresponding gear teeth on drive pinions 158. Pinions 158 are mounted on a pinion shaft 160 which, in turn, is supported on the beams 16 by journal blocks 162 mounted on upwardly projecting, rigid brackets 164. Pinion shaft 160 is driven, through a sprocket 166 mounted on one end thereof, by a chain 168 which, in turn, is driven by pusher drive motor 170 acting through a suitable reduction gear mechanism 172 and sprocket 174. The reduction gear mechanism 172 is preferably reversible and includes suitable clutching mechanisms to permit the pusher head to be driven in either direction.

Due to the length of travel of the pusher head 130, the pusher arms 132, 134 must necessarily be quite long. For example. a machine employed to push an oven having a coking chamber 50 feet in length requires a total length of the pusher arms of approximately 69 feet. The additional length is required both by the fact that the arms must be supported at some distance from the front of the oven and by the fact that the pusher head must be employed to push the coke completely through and beyond the oven into a hot car supported on tracks extending along the back of the bank of ovens.

When the pusher head 130 is extended into an oven, a substantial portion of the cantilevered weight of the pusher head and arms is supported by the floor of the oven through an elongated roller 176 supported, as by mounting brackets 178 on the pusher head 130. When the pusher head 130 is in the retracted position illustrated in FIGS. 1 through 7, the pusher arms extend in cantilevered relation rearwardly a substantial distance beyond the rearmost support roller 150, and their weight may tend to raise the pusher head about this rearmost roller as a pivot point. To avoid this, a pair of hold-down rollers 180, each supported by a pair of journal bearings 182 rigidly mounted on support blocks 184, engage the top surface of the pusher arms 132, 134. The hold-down rollers 180 have a recessed central portion 186 spanning the rack 156, and a pair of flanges 188 on their respective ends extend along the side of and act as a guide for the top flange 138.

Referring now to FIGS. 8–10, it is seen that the pusher head 130 is of a hollow core construction, made up of a plurality of individual structural beams and plates rigidly welded together to provide six parallel, horizontally extending channels 190, 191, 192, 193, 194, and 195 extending therethrough. The main body of the pusher head 130 is made up of five H-beams stacked on top of one another and having their flanges rigidly welded together and cooperating to form, in ffect, two parallel, spaced vertical plates joined by the webs 196 of the beams to define four of the channels. The top and bottom channels 190, 195, respectively, are defined by welded plate sections joined to the upper and lower H-beam flanges. A continuous plate 197 is welded to the forward face of the pusher head to provide a continuous, smooth surface for engaging and pushing the incandescent cake of coke from an oven, and a pair of end plates 198 close the opposed ends of the assembly.

An opening 200 is provided in the web 196 of the topmost H-beam, adjacent one end thereof, to provide fluid communication between channels 190 and 191, and a similar opening 202 is formed in the web of the adjacent H-beam 196 at the opposite end of the pusher head to provide fluid communication between channels 191 and 192. A pipe 204 is rigidly welded within the pusher head 130 and has one end in fluid communication with the channel 144 of the pusher arm 132 and its other end in fluid communication with the channel 190 at the end thereof opposite the opening 200. A second pipe 206 is rigidly welded within the head 130 and has its open ends communicating with the channel 148 in the pusher arm 134 and the channel 192 at the end thereof opposite the opening 202.

Similarly, an opening 208 in one end of the H-beam web between channels 193 and 194 provides fluid communication therebetween, and an opening 210 in the lowermost H-beam web provides fluid communication between channels 194 and 195. Also, pipes 212 and 214 are rigidly welded within the pusher head assembly, with pipe 212 having its open ends providing fluid communication between the channel 144 of pusher arm 134 and the channel 195, while pipe 212 provides fluid communication between the channel 148 of pusher arm 132 and the fluid channel 193.

A pair of flexible hoses 214, 216 are connected to the ends of the pusher arms 132, 134 remote from the pusher head, and cooling water, under pressure, is directed therethrough into the channels 144 of the respective pusher arms. This cooling water flows through the pipe 204 into the top channel 190 of the pusher head, down through the opening 200 into the channel 191, thence through opening 202 to the channel 192, and out the pipe 206 and the channel 148 in pusher arm 134 to cool the top half of the pusher head. At the same time, water flows from channel 144 through the pipe 212 into the bottom channel 195 and out of the channel 193 through pipe 214 and channel 148 of the pusher arm 132. Thus, the cooling water serves not only to cool the pusher head 130 but also to cool the structural elements of the pusher arms. Suitable flexible conduits, not shown, are provided on the rear end of the pusher arms for conveying the heated water to a cooling tower or other appropriate point of disposal. By cooling the pusher head, the expense of frequent replacements of this structural element is avoided. More important, however, are the advantages derived from the more efficient pushing of the coke from the oven due to the fact that the cooled head does not warp. Further, substantial savings are realized by the fact that the pushing and charging machine does not have to be taken out of operation for the customary frequent pusher head changes.

Referring to FIG. 2, it is seen that when the machine 10 is positioned in front of the bank of ovens 12 so that the pusher head 130 is in axial alignment with the coking chamber of one oven in the bank, such as oven 12*b*, the right door handling assembly 52 is positioned in front of an adjacent oven 12*a*, with a movable oven charging conveyer assembly 220 in axial alignment with the coking chamber in the oven 12*a*. Coal to be deposited into the oven 12*a* (after the pusher door thereof has been removed) is fed from a large hopper 222. The hopper 222 has vertically extending end walls 224, 226 spaced apart a distance substantially equal to the width of the coking chamber of the oven, and inclined side walls 228, 230 (FIG. 6) which terminate at their lower edge in spaced relation to one another to define an elongated open feed slot 232 extending the full width of the hopper. Opening 232 may be closed by a suitable valve member such as the sliding plate 234 (see FIG. 12) actuated by a double acting linear fluid motor 236. Hopper 222 and the oven charging conveyor 220 are supported on the frame assembly 14 by a separate, vertically movable frame assembly 238 described more fully hereinbelow.

Conveyor 220 is made up of an elongated generally rectangular frame structure defined by a pair of identical, laterally spaced parallel side beams 240, 242 joined at their respective ends by transversely extending shafts 244, 246, and at spaced points intermediate their ends by a plurality of elongated, rigid spacer members 248. The individual side beams 240, 242 are substantially identical in construction and accordingly only beam 240 will be described in detail, with identical reference numerals being employed to designate similar elements of the two beams. Thus, beam 240 is made up of a pair of structural channels 250, 252 supported in vertically aligned, spaced relation to one another by a plurality of rigid gusset members 254. A pair of side plates 256, 258 are welded to the edges of the flanges of the respective channels and cooperate therewith to define a pair of rectangular fluid conduits 260, 262 extending the full length of the conveyer frame. The fluid conduits 260, 262 are connected at the forward end of the conveyer by a rigidly welded semicircular conduit section 264. Cooling water, under pressure, is supplied to the conduit 262 by a flexible hose 265 connected to the end of the side beam farthest from the ovens. The cooling water circulates through the conduit 262, the arcuate section 264 and the conduit 260 to be discharged through a second flexible hose 266 connected in fluid communication with the conduit 260.

Mounted on the upper surface of each of the side beams 240, 242 is an elongated, channel-shaped rack 268 having recessed gear teeth 270 in the central portion thereof for engaging mating gear teeth on a drive pinion 272 mounted on a transversely extending shaft 274. The shaft 274 is journaled for rotation by bearings 276 and is driven, through sprocket 278 and chain 280, by a suitable electric motor 282 acting through a reversible reduction gear mechanism 284.

Figure 11:
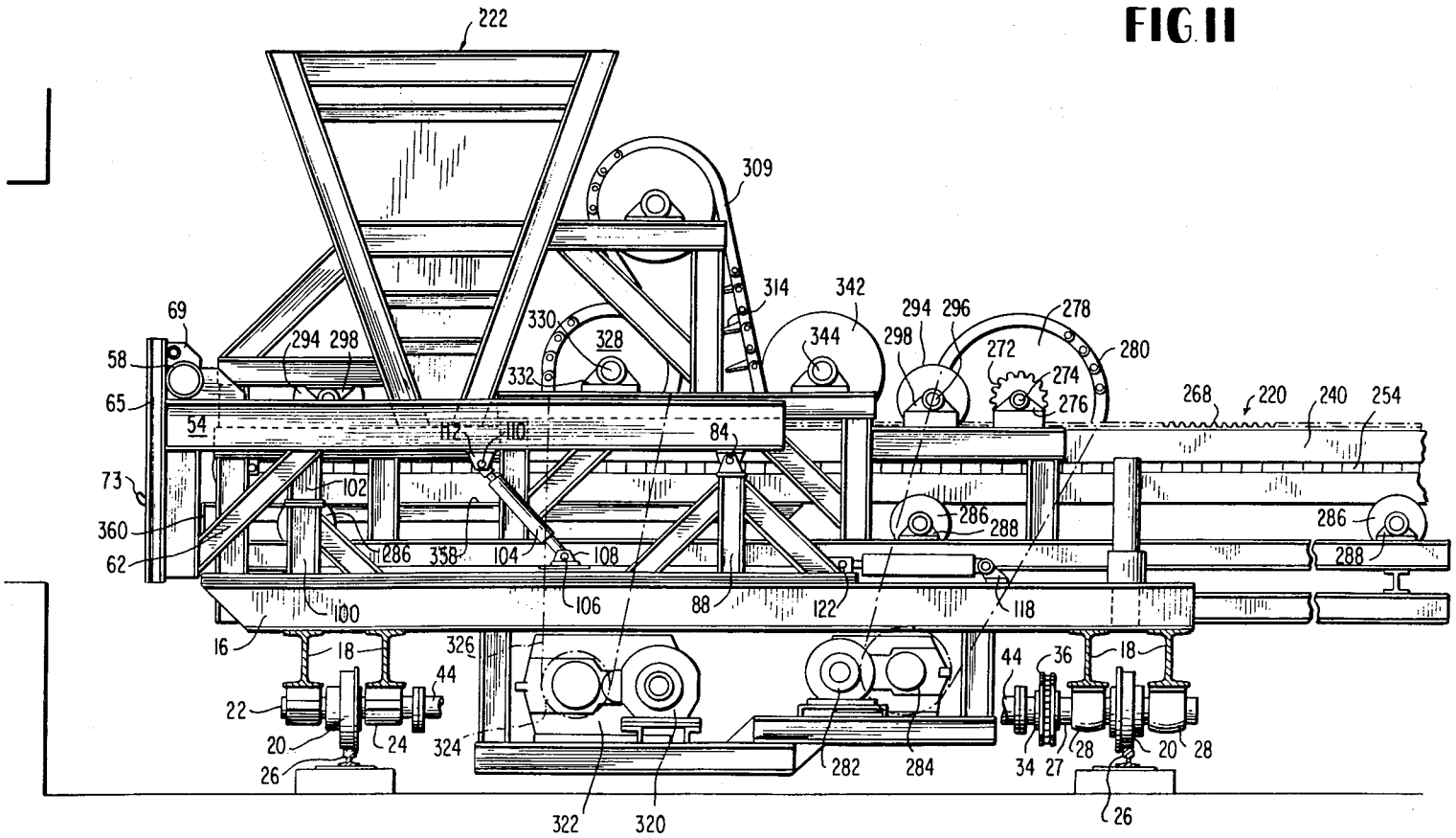
FIG. 11 is an elevation view of the portion of the structure shown in FIG. 6.

The side beams 240, 242 are supported for longitudinal movement toward and away from the bank of ovens 12 by a plurality of conveyer support rollers 286 mounted on shafts 287 which, in turn, are supported for rotation by bearing members 288 mounted at spaced points along transverse frame members 16. Rollers 286 each have a recessed central portion 290 which engages and supports the bottom surface of the channel 252, and a radially extending flange portion 292 which projects upwardly along the outer surface of the beam to maintain the beam in alignment parallel with the longitudinal axis of the coking oven. A pair of hold-down rollers 294, similar in construction to the conveyor support rollers 286, engage the top surface of the rack members 268 to hold the conveyer assembly against pivotal movement about the rearmost conveyer support roller 286 upon movement of the conveyer assembly to its fully retracted position shown in FIG. 11. Rollers 294 are mounted on suitable idler shafts 296 supported for rotation about their longitudinal axes by bearings 298.

Figure 13:
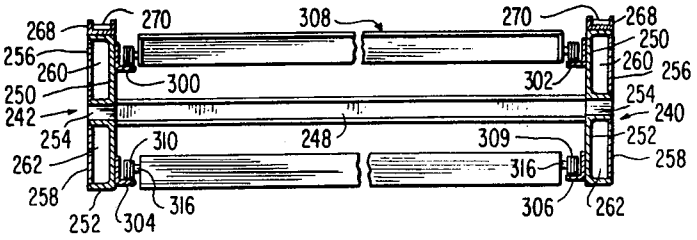
FIG. 13 is an enlarged sectional view taken on line 13—13 of FIG. 12.
Figure 14:
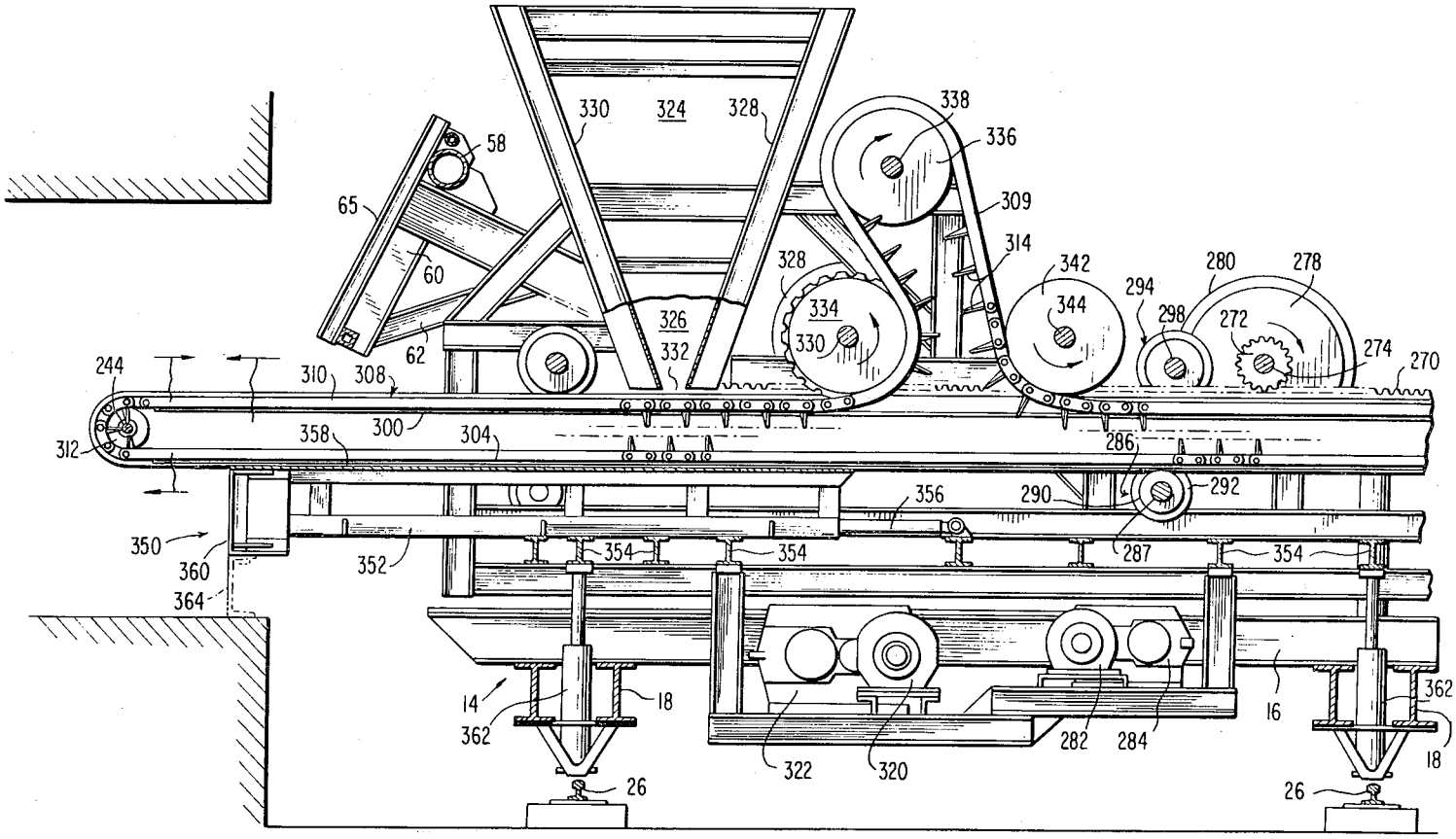
FIG. 14 is a view similar to FIG. 12, and illustrating the conveyer mechanism being moved into the coking chamber.

Referring to FIG. 13, it is seen that a first pair of angle members 300, 302 are mounted on the inner surfaces of beams 240, 242 adjacent the top edge thereof and in opposed relation to one another, and a second pair of angle members 304, 306 are rigidly welded to the inner surface of the beams adjacent the lower edge thereof. The angles 300, 302 cooperate to define a support track for the top, return run of an endless driven chain conveyor 308, while angles 304, 306 cooperate to define the support track for the lower, conveying run of the conveyer chain assembly. The conveyer chain assembly 308 is made up of a pair of endless chains 309, 310, with the chain of 309 extending along the inner surface of side beam 240 and supported by the angle tracks 302 and 306, while chain 310 extends along the side beam 242 and is supported by the tracks 300 and 304. The chains 309, 310 extend over sprockets 312 (only one of which is shown in FIG. 14) mounted on the ends of shafts 244, 246, and are held in their spaced parallel relation by a plurality of elongated, rigid conveyer flight members, or drag bars 314. The drag bars 314 are generally L-shaped in cross section, and have their opposed ends connected, as by mounting brackets 316, to the individual links of the chains 309, 310.

The conveyer chain assembly is driven about its endless path by an electric motor 320, acting through a suitable reduction gear mechanism 322, sprocket 324, and drive chain 326. The drive chain 326 extends over a sprocket 328 mounted on a drive shaft 330 extending transversely across the conveyer assembly and mounted for rotation about its longitudinal axis by a pair of bearing blocks 332. A pair of conveyer drive sprockets 334 are mounted on the shaft 330 in position to engage and drive the chains 309, 310 upon rotation of the shaft 330 by the drive chain 326. To assure adequate driving engagement between the conveyer chains 309, 310 and the driving sprockets 334, the chains are trained upwardly around the sprockets 334 and over idler sprockets 336 mounted on a shaft 338 which, in turn, is journaled for rotation about its axis by a pair of bearings 340. From the idler sprockets 336, the chains are trained downwardly and beneath a second pair of idler sprockets 342 mounted on a shaft 344 extending transversely of the conveyer assembly and journaled for rotation about its axis by a pair of bearing blocks 346. Since the shafts 330, 338 and 344, as well as motor 320 and reduction gear 22, are mounted on the movable frame structure 238, operation of the drive sprocket 328 will move the conveyer chain assembly about its endless path along the rectangular conveyer frame structure independently of the position of the machine frame 14, or of its movement by the conveyer drive pinion 272.

A false door and bridge assembly 350 is slidably mounted on the movable frame structure 238 beneath the movable conveyer structure 220 in the area of the coal hopper 222. The false door and bridge assembly includes a generally rectangular frame structure 352 supported on a plurality of support members 354 of frame 238, and is moved between its retracted position shown in FIG. 11 and an extended position shown in FIG. 12 by a pair of identical double acting linear fluid motors 356. Frame 352 has a smooth horizontal top surface 358 which extends between the side beams 240, 242 and acts as a floor surface bridging the space from the hopper 222 and the ovens 12 and over which coal discharged from hopper 222 is dragged by the conveyer drag bars 314.

Mounted on the forward end of the frame 352 is a generally rectangular false door 360 adapted to be projected into and substantially fill the pusher door opening throughout its width and to a height substantially equal to the depth of the charge of coal to be deposited into the oven when the assembly is in its extended position shown in FIGS. 12 and 14. The forward conveyer support roller 286 also acts as a guide for the false door and bridge assembly in its reciprocal movement to assure that the floor 358 remains in position between the side beams 240, 242 to thereby assure that no coal is spilled as it is being conveyed from the hopper to the oven between the side beams.

Referring to FIG. 14, it is seen that the depth of the charge of coal to be deposited in an oven may be varied by the simple expedient of elevating the charging conveyer and the false door and bridge assemblies. This is accomplished by supporting the conveyer structure, including the door handling assembly 52, the hopper 222, the conveyer assembly 220, and the false door and bridge assembly 350 on the movable frame assembly 238, which, in turn, is supported on girders 18 by four large, single-acting fluid cylinders 362. In the drawings, the false door 360 is illustrated as having a height equal to the minimum depth of a charge of coal to be deposited in the oven. When it is desired to deposit a deeper charge in the oven, cylinders 362 elevate the frame 238 to raise the bottom surface of the false door above the floor of the oven. When the bottom edge of the false door is only slightly above the oven floor, a small amount of coal may tend to flow beneath the false door and into the door opening, but this amount will not be enough to interfere with replacement of the oven door after completion of the oven charging operation. However, when a substantially deeper charge is to be deposited in the oven, it may be desirable to employ an extension 364 (illustrated in phantom) in the form of a structural channel or the like bolted to the bottom surface or front face of the false door assembly. Also, if desired, once the false door and conveyer assembly is adjusted to the desired height by the fluid motors 362, the subframe assembly 238 may be blocked up on the cross members 16 of the frame 14 to thereby relieve the load on the fluid motors and assure a constant, uniform elevation of the assembly.

While the hopper assembly may be of sufficient size to hold a complete charge of coal to be deposited into an oven, this would require an extremely large hopper for some modern coking ovens which may take a charge of from 25 to 40 tons of coal. To avoid the necessity of such a large hopper, conveyer means is provided to supply coal to the hopper during the filling operation, with the hopper acting as an accumulator to assure a uniform, even distribution of coal across the entire width of the conveyer assembly 220. Also, by commencing the charging operation with a full hopper, the size of the conveyer required to supply the coal to the machine may be reduced. As indicated in FIGS. 1 and 2, the coal supply conveyer, indicated generally by the reference numeral 366, may be in the form of a driven endless belt 368 extending along and supported on the front of the bank of ovens 12. A driven belt diverter conveyer 370 is mounted on tracks 372 and is connected to hopper 222, as by arm 374, for movement therewith along its path in front of the bank of ovens. The diverter conveyer 370 is of conventional construction and cooperates with the endless belt 368 to deliver the coal from the conveyer to the hopper.

A pushing and charging apparatus of the type described above has been constructed for use in pushing and charging a bank of ovens having coking chambers 11 feet in width and slightly over 50 feet in length. Such an oven may require a charge of approximately 26 tons of crushed coal, when the oven is operated on a 24 hour cycle, or approximately 40 tons of coal when operated on a 48 hour cycle. In this initial embodiment of the machine, the hopper 222 has a capacity of 13.5 tons, which has been found to be adequate, when supplemented with the conventional belt conveyor system illustrated in FIGS. 1 and 2, to maintain a uniform supply of coal through hopper 222 to the charging conveyer 220. The charging conveyer, per se, in this initial embodiment of the apparatus has an overall length of approximately 69 feet and a total width of approximately 10 feet, 10 inches. The charging conveyer positioning rack has a total length of 58 feet, with the total travel of the conveyer from its fully retracted position to its extended position being slightly less than 58 feet.

The coke pusher head similarly has a width of approximately 10 feet, 10 inches, with the pusher arms being 67 feet in length. The positioning racks on the pusher arms have a total length of 63 feet, with a pusher head having a total travel slightly less than 63 feet. This travel is sufficient to project the pusher head completely through the oven to push a charge of coke across the catwalk and into a hot car positioned at the coke end of the oven.

In use of the apparatus described above, the pushing and charging machine is positioned at the right hand end of the bank of ovens, as viewed from the operator's station, with the pusher ram centered in front of the first oven in the bank and with the charging conveyer extending beyond (to the right as viewed by the operator) the end of the bank of ovens. In this position, the left door handling assembly 50 moves forward and clamps the oven door. The oven door locking mechanism is then released, and the door is withdrawn from the oven and lifted upwardly to permit the pusher head to be telescoped therebeneath. At the same time, a conventional door lifting mechanism 375 has been actuated to remove the coke door from the opposite end of the oven, and to position the conventional coke apron, or ramp 376, in front of the open coke door to provide a chute for the coke across the rear catwalk 378 and into the hot car 380.

With cooling water being pumped through the supply hoses 216, 218 and circulated through the pusher head 130, the pusher arms 132, 134 are then telescoped into the oven to push the cake of coke through the oven into the waiting hot car. As soon as the coke is pushed through the oven, the reduction gear mechanism 172 is reversed to withdraw the pusher head through the oven, and the two oven doors are quickly replaced to conserve heat in the oven. Motor 38 is then energized to move the pushing and charging machine along the bank of ovens to position the pusher in front of the second oven and the charging conveyer in front of the first oven which has just been pushed.

The second door handling assembly 52 is then actuated as described above to again remove the pusher door from the first oven, and fluid motor 356 actuated to move the false door and bridge assembly 350 forward to position the false door 360 in the open oven door. The charging conveyer motor 320 is then energized to drive the endless chain conveyer about its path, and motor 282 is energized to start telescoping the conveyer into the coking chamber. At the same time, valve 234 is opened to permit coal to flow from hopper 222 onto the conveyer, and the coal delivery conveyer is energized to deliver additional coal to the hopper. Coal dropping through hopper 222 will pass down through the top flight of the chain conveyer and be deposited on the surface 358 to be dragged therealong by the drag bars 314 into the open oven. By driving the conveyer chain at a rate to fill the coking chamber to the desired level substantially as fast as the conveyer is telescoped into the oven, the charge of coal deposited on the oven floor, acting through the conveyer drag bars and the bottom surfaces of the side beams 240, 242, supports a substantial portion of the cantilivered weight of the conveyer assembly. This weight of the conveyer assembly, in combination with the live action of the conveyer drag bars moving over the charge, compacts the crushed coal throughout the length of the coking chamber.

The tendency of the conveyer assembly to sag under its own cantilevered weight toward the back of the coking oven places a slightly greater compacting load on the charge in this area. However, this effect is compensated for by the increased compaction of the live load effect of the conveyer on the charge toward the front of the oven, with the result that substantially uniform compaction is obtained throughout the oven. Also, in order to obtain a more uniform depth of charge throughout the length of the oven, the charging conveyer mechanism is telescoped into the oven at a slightly upwardly inclined angle to compensate for the sagging of the conveyer toward the back of the coking chamber.

Since the charging conveyer assembly is substantially the same width as the coking chamber, and since coal is delivered to the conveyer uniformly across its entire width, the charge of coal deposited in the chamber is of uniform depth and density throughout the width of the chamber. Since the drag bars and the conveyer chain structure are in contact with the relatively cool coal throughout the bottom run of the conveyer path, they are exposed to the intense oven heat only for the relatively short period of time of the upper return run of the path. Further, the water cooled side beams shield the conveyer chains against the intense heat radiated from the hot oven walls even during the return run so that the chain life is greatly increased. The relatively large volume of cooling water contained in and circulated through the side beam 240, 242 maintain these structures at a safe operating temperature despite the fact that they are in extremely close proximity to and sometimes may even be in contact with the sidewalls of the coking chamber throughout the charging operation.

By closing the hopper valve plate 234 slightly before the oven is completely charged, the last coal delivered to the conveyer will be conveyed to the back of the oven to complete the charge, leaving the top of the charge in a smooth, level, compact condition. As soon as the complete charge of coal is deposited in the oven, the reduction gear mechanism 284 is reversed to retract the charging conveyer. During this retracting process, the conveyer chains are continuously driven at a rate substantially equal to the rate at which the assembly is being withdrawn so that the bottom flight of the conveyer chain remains substantially stationary with respect to the charge of coal rather than being dragged back over the oven charge, thereby avoiding any tendency to drag coal from the oven or to disturb the top surface of the charge.

As soon as the conveyer assembly is withdrawn from the oven, the false door and bridge assembly is withdrawn, and the door handling assembly is actuated to replace the oven door. It has been found that a 40 ton charge of coal can be deposited, in a level, compact condition, into the large oven described above by this mechanism in less than four minutes. This extremely fast charging procedure not only conserves vast amounts of heat in the oven, but also virtually eliminates the usual discharge of smoke and gases into the atmosphere during the conventional charging and leveling process.

If the pushing and leveling machine is operated by a single operator, then the next step in the procedure will normally be to push the second oven in the manner described above with regard to the first oven. Upon completion of this second pushing operation, the entire pushing and charging machine is then advanced along the bank of ovens to place the pusher in front of the third oven, and the procedure repeated to push and charge the entire bank of ovens. If desired, two operators can be employed so that one oven may be pushed while the adjacent oven is being charged, thereby substantially decreasing the total amount of time required to push and charge a bank of ovens. However, this generally is not considered necessary since the apparatus can push and charge a large bank of ovens within a relatively short period of time. Further, such a fast pushing operation may overload the quenching sheds and require additional equipment and personnel to maintain the supply of hot cars in position to receive the coke.

While I have disclosed and described a preferred embodiment of my invention, I wish it understood that I do not intend to be restricted solely thereto, but rather that I intend to include all embodiments thereof which would be apparent to one skilled in the art and which come within the spirit and scope of my invention.

What is claimed is:

1. In a machine for pushing hot coke from a coke oven of the type including a horizontal coking chamber having its open ends normally closed by removable doors, said machine including a rigid pusher head having a substantially vertical front face generally corresponding in size and configuration to the vertical cross section of the coking chamber and adapted to engage and push the hot coke therefrom, and an elongated pusher ram supporting the pusher head for movement through the oven from one end to the other end thereof, the improvement wherein said pusher head comprises a rigid steel assembly having a hollow central core and formed of a plurality of structural steel beams rigidly welded together, said beams having integrally formed web and flange portions with the flanges being welded together to define external walls of the pusher head and with the webs forming baffles dividing the interior of the pusher head into a plurality of parallel horizontal fluid channels extending substantially the full length of the pusher head throughout the full height thereof, and apertures formed in said webs to provide a continuous passage through which cooling liquid may be circulated to cool the pusher head throughout, and conduit means connected to said channels and providing a fluid circuit for circulating a cooling liquid through said hollow core to cool said pusher head.

2. In a machine for pushing hot coke from a coke oven of the type including a horizontal coking chamber having its open ends normally closed by removable doors, said machine including a rigid pusher head having a substantially vertical front face generally corresponding in size and configuration to the vertical cross section of the coking chamber and adapted to engage and push the hot coke therefrom, and an elongated pusher ram supporting the pusher head for movement through the oven from one end to the other end thereof, the improvement wherein said pusher head comprises a rigid steel assembly having a hollow central core defined by rigidly welded external walls, baffle means in said pusher head and dividing said hollow core into a plurality of fluid channels, said pusher ram comprising a pair of hollow beam members, each of said beam members being an I-beam having a web and opposed flanges, a pair of plates lying parallel to the web and on opposite sides thereof, said plates being connected to the flanges to form hollow longitudinal passages for circulation of cooling liquid therethrough, said hollow beams being connected to said channels in said pusher head for circulating cooling liquid through said hollow core to cool said pusher head.

3. The invention as defined in claim 2 wherein said pusher head comprises a plurality of structural steel beams rigidly welded together, said beams having integrally formed web and flange portions with the flanges being welded together to define external walls of the pusher head and with the webs dividing the interior of the pusher head into a plurality of parallel, horizontal channels extending substantially the full length of the pusher head throughout the full height thereof, and apertures formed in said webs to provide a continuous passage through which cooling liquid may be circulated to cool the pusher head throughout.

* * * * *